US010501971B2

(12) United States Patent
Zhang et al.

(10) Patent No.: US 10,501,971 B2
(45) Date of Patent: Dec. 10, 2019

(54) HINGE AND REFRIGERATOR HAVING THE SAME

(71) Applicants: QINGDAO HAIER JOINT STOCK CO., LTD., Qingdao, Shandong Province (CN); QINGDAO HAIER SPECIAL REFRIGERATOR CO., LTD., Qingdao, Shandong Province (CN)

(72) Inventors: Hao Zhang, Qingdao (CN); Enpin Xia, Qingdao (CN); Xiaobing Zhu, Qingdao (CN)

(73) Assignees: QINGDAO HAIER JOINT STOCK CO., LTD., Qingdao, Shandong Province (CN); QINGDAO HAIER SPECIAL REFRIGERATOR CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 15/745,110

(22) PCT Filed: Jun. 17, 2016

(86) PCT No.: PCT/CN2016/086161
§ 371 (c)(1),
(2) Date: Jan. 15, 2018

(87) PCT Pub. No.: WO2017/020659
PCT Pub. Date: Feb. 9, 2017

(65) Prior Publication Data

US 2018/0209190 A1 Jul. 26, 2018

(30) Foreign Application Priority Data

Aug. 5, 2015 (CN) ..... 2015 1 0474609

(51) Int. Cl.
*E05D 5/14* (2006.01)
*E05D 3/02* (2006.01)
(Continued)

(52) U.S. Cl.
CPC ..... *E05D 5/14* (2013.01); *E05D 3/02* (2013.01); *E05D 5/10* (2013.01); *E05D 5/12* (2013.01);
(Continued)

(58) Field of Classification Search
CPC ..... E05Y 2900/31; E05Y 2800/402; E05Y 2800/33; E05Y 2800/28; E05D 5/14;
(Continued)

(56) References Cited

U.S. PATENT DOCUMENTS 2,835,359 A * 5/1958 Boldt ..... E05D 7/081 49/402
3,154,803 A * 11/1964 Parsons ..... E05D 5/10 16/250
(Continued)

FOREIGN PATENT DOCUMENTS

CN 201276915 Y 7/2009
CN 201301621 Y 9/2009
(Continued)

*Primary Examiner* — Hiwot E Tefera
(74) *Attorney, Agent, or Firm* — Cheng-Ju Chiang

(57) ABSTRACT

The present invention provides a hinge and a refrigerator having the same. The hinge has a fixing plate, a supporting plate perpendicularly connected with the fixing plate, and a hinge shaft perpendicularly mounted on the supporting plate to cooperate with a shaft sleeve, wherein the outside of the hinge shaft is plastic-encapsulated with a plastic encapsulating case, the plastic encapsulating case is provided with a protrusion protruding horizontally outwards along the extension direction of the supporting plate, and the protrusion is integrally formed with the plastic encapsulating case.

12 Claims, 1 Drawing Sheet

(51) Int. Cl.

| | |
|---|---|
| ***E05D 5/10*** | (2006.01) |
| ***E05D 5/12*** | (2006.01) |
| ***F25D 23/02*** | (2006.01) |
| *E05D 7/081* | (2006.01) |

(52) U.S. Cl.
CPC ..... *F25D 23/028* (2013.01); *E05D 7/081* (2013.01); *E05D 2005/102* (2013.01); *E05D 2005/104* (2013.01); *E05D 2005/106* (2013.01); *E05Y 2800/28* (2013.01); *E05Y 2800/33* (2013.01); *E05Y 2800/402* (2013.01); *E05Y 2900/31* (2013.01)

(58) Field of Classification Search
CPC .... E05D 5/10; E05D 5/12; E05D 3/02; E05D 7/08; E05D 7/081; E05D 5/125; E05D 5/127; E05D 5/128; E05D 7/1005; E05D 2005/102; E05D 2005/104; E05D 2005/106; E05D 2005/108; E05D 5/121; E05D 2005/122; E05D 2005/124; E05D 7/1022; E05D 7/1055; F25D 23/028; F25D 2323/024; Y10T 16/557
See application file for complete search history.

(56) References Cited

U.S. PATENT DOCUMENTS 3,430,386 A * 3/1969 Schmitt ..... E05D 3/04 312/109
4,090,274 A * 5/1978 Bourgeois ..... E05F 1/063 16/317
4,543,800 A * 10/1985 Mawby ..... E05D 11/0081 439/165
4,793,021 A * 12/1988 Deasy ..... B60B 33/0002 16/273
4,864,691 A * 9/1989 Gidseg ..... E05D 3/04 16/312
4,964,193 A * 10/1990 Rommelfaenger ... E05D 11/082 16/225
5,158,503 A * 10/1992 Mitchell ..... E05D 3/12 16/278
5,187,837 A * 2/1993 Gunderson ..... E05D 3/04 16/351
5,237,723 A * 8/1993 Little ..... E05D 3/02 16/261
5,548,869 A * 8/1996 Ryczek ..... E05D 7/0018 16/235
5,920,959 A * 7/1999 DeMarco ..... E05D 7/1022 16/257
5,940,936 A * 8/1999 Lu ..... G06F 1/1616 16/337
6,171,011 B1 * 1/2001 Wu ..... G06F 1/1616 16/337
8,827,389 B2 * 9/2014 Lee ..... F25D 23/028 16/243
2002/0009903 A1 * 1/2002 Malnati ..... H01R 13/6633 439/38
2004/0083578 A1 5/2004 Rader
2006/0143860 A1 * 7/2006 Park ..... E05D 7/0027 16/243
2006/0231218 A1 * 10/2006 Liang ..... E05D 15/26 160/206
2009/0038117 A1 * 2/2009 Moon ..... E05D 7/0027 16/240
2010/0218342 A1 * 9/2010 Bertolini ..... E05D 7/0027 16/244
2011/0049834 A1 * 3/2011 Natu ..... F16C 11/04 280/279
2012/0037644 A1 * 2/2012 Lee ..... E05D 7/0027 220/592.09
2012/0240350 A1 * 9/2012 Natu ..... E05D 5/14 16/2.2
2013/0067688 A1 3/2013 Kim
2013/0249373 A1 * 9/2013 Lively ..... E05D 7/0027 312/405
2014/0259529 A1 * 9/2014 Jenkinson ..... E05D 7/0027 16/248
2016/0069112 A1 * 3/2016 Neumark ..... E05D 3/022 16/276

FOREIGN PATENT DOCUMENTS

| | | | |
|---|---|---|---|
| CN | 201835662 | U | 5/2011 |
| CN | 202578266 | U | 12/2012 |
| CN | 202627757 | U | 12/2012 |
| CN | 203547338 | U | 4/2014 |
| CN | 203570057 | U | 4/2014 |
| CN | 204040711 | U | 12/2014 |
| CN | 104631983 | A | 5/2015 |
| CN | 104806098 | A | 7/2015 |
| CN | 105089400 | A | 11/2015 |
| CN | 204920558 | U | 12/2015 |

* cited by examiner

HINGE AND REFRIGERATOR HAVING THE SAME

CROSS REFERENCE TO RELATED APPLICATIONS

The present application is a 35 U.S.C. § 371 National Phase conversion of International (PCT) Patent Application No. PCT/CN2016/086161, filed on Jun. 17, 2016, which further claims benefit of Chinese Patent Application No. 201510474609.7, filed on Aug. 5, 2015, the disclosure of which is incorporated by reference herein. The PCT International Patent Application was filed and published in Chinese.

TECHNICAL FIELD

The present invention relates to a hinge and a refrigerator having the same.

BACKGROUND

For a traditional hinge, a hinge plate and a hinge shaft are fitted together by riveting. As there are errors during fitting and the parts themselves also have errors, the perpendicularity between the hinge shaft and the shaft sleeve cannot meet the requirement, and the door using such a hinge cannot be tightly closed or there will be a flash clearance.

Accordingly, the shaft sleeve cooperating with the hinge shaft will radially shake during use due to the fitting clearance between the hinge shaft and the shaft sleeve, or the frictional force between the hinge shaft and the shaft sleeve will be excessive due to an excessive contact area therebetween, which will damage the hinge shaft. In addition, as the hinge used in a refrigerator is always exposed in a humid and cold environment and can be easily corroded, existing solutions for preventing hinge corrosion are usually complex in process or costly.

In view of the above, it is necessary to improve the traditional hinge to solve the above problems.

SUMMARY

An object of the present invention is to provide a hinge and a refrigerator having the same to solve the problems of an existing refrigerator of corrosion of the hinge shaft, an excessively large fitting clearance between the hinge shaft and the shaft sleeve, and excessive frictional force therebetween.

To realize the above object, the present invention provides a hinge, which comprises a fixing plate, a supporting plate perpendicularly connected with the fixing plate, and a hinge shaft perpendicularly mounted on the supporting plate to cooperate with a shaft sleeve, wherein the outside of the hinge shaft is plastic-encapsulated with a plastic encapsulating case, the plastic encapsulating case is provided with a protrusion protruding horizontally outwards along the extension direction of the supporting plate, and the protrusion is integrally formed with the plastic encapsulating case.

As an improvement of the present invention, two protrusions are arranged on the plastic encapsulating case, and are respectively arranged on the two sides of the supporting plate in the height direction of the hinge shaft.

As another improvement of the present invention, the protrusion protrudes outwards in a ring shape.

As yet another improvement of the present invention, the protrusion comprises an abutting portion to cooperate with the shaft sleeve in an abutting manner and a transition zone connecting the abutting portion and the plastic encapsulating case in an arc shape.

As yet another improvement of the present invention, the supporting plate is provided with a mounting hole for mounting the hinge shaft which is to be inserted into and fixed in the mounting hole.

As yet another improvement of the present invention, the hinge shaft passes through the mounting hole and is fixed on the supporting plate by a rivet.

As yet another improvement of the present invention, the fixing plate is provided with three screw holes.

To realize the above object, the present invention further provides a refrigerator comprising a cabinet, a door and the above hinge.

The present invention has the following advantageous effects. On one hand, the hinge of the present invention is plastic-encapsulated with a plastic encapsulating case on the hinge shaft, which can prevent corrosion of the hinge shaft and enhance the structural strength thereof. On the other hand, a protrusion is provided on the plastic encapsulating case to cooperate with the shaft sleeve, which can reduce the fitting clearance between the hinge shaft and the shaft sleeve, avoid radial shaking of the door and reduce the contact area between the hinge shaft and the shaft sleeve to reduce the frictional force therebetween. Further, the hinge is economical and easy to manufacture.

DETAILED DESCRIPTION

To make the objects, technical solutions and advantages of the present invention clear, the followings will describe the present invention in detail using specific embodiments with reference to the drawings.

Figure 1:
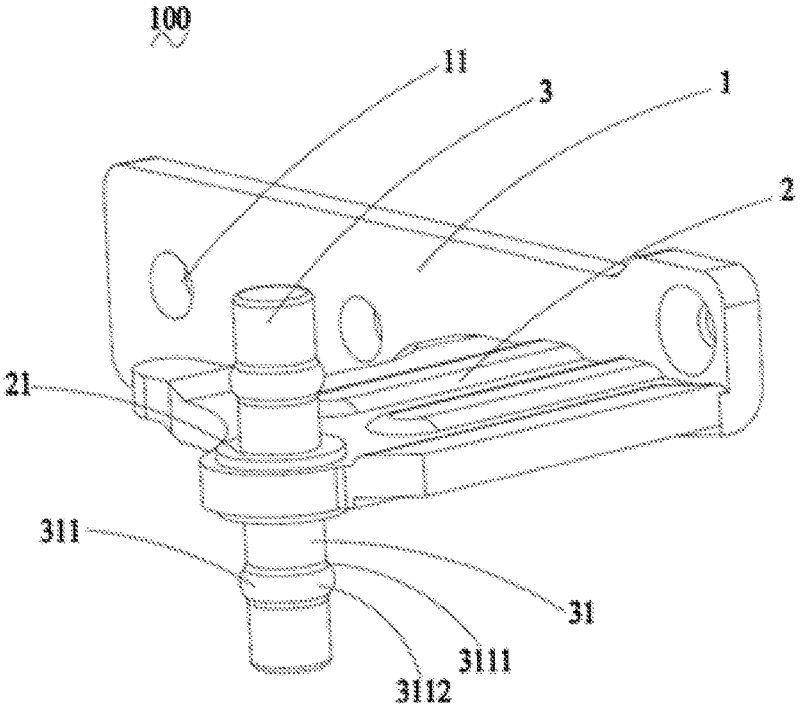
FIG. 1 is a schematic structural view of the present invention.
Figure 2:
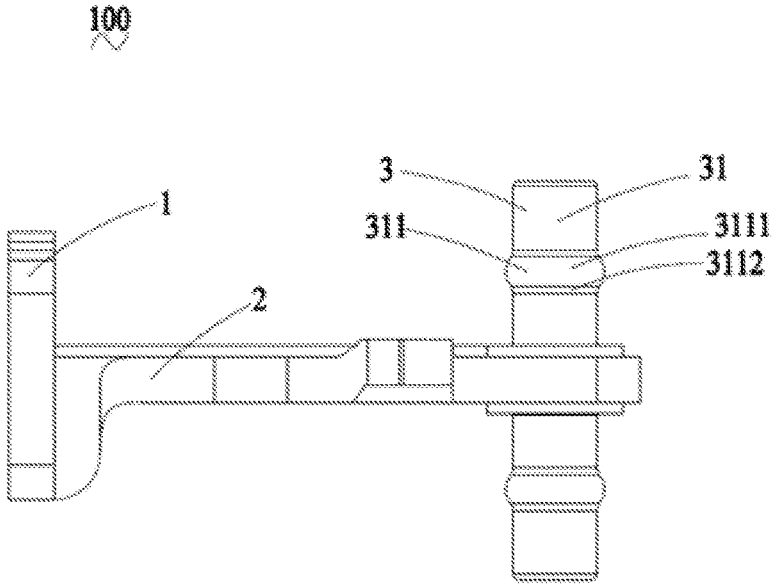
FIG. 2 is a side view of the hinge of the present invention.

As shown in FIGS. 1 and 2, the refrigerator (not shown in the drawings) of the present invention comprises a cabinet (not shown in the drawings), a door (not shown in the drawings) and a hinge 100 for connecting the cabinet and the door.

The door comprises a shaft sleeve (not shown in the drawings) to cooperate with the hinge 100.

The hinge 100 comprises a fixing plate 1, a supporting plate 2 perpendicularly connected with the fixing plate 1, and a hinge shaft 3 perpendicularly mounted on the supporting plate 2 to cooperate with the shaft sleeve.

The fixing plate 1 is provided with three screw holes 11.

The supporting plate 2 is provided with a mounting hole 21 for mounting the hinge shaft 3 which is to be inserted into and fixed in the mounting hole 21. In the present embodiment, the hinge shaft 3 passes through the mounting hole 21 and is fixed on the supporting plate 2 by a rivet. Of course, the hinge shaft 3 may be fixed on the supporting plate 2 in other manners.

The outside of the hinge shaft 3 is plastic-encapsulated with a plastic encapsulating case 31 which can prevent corrosion of the hinge shaft 3 and increase the structural strength thereof. The thickness at respective parts of the plastic encapsulating case 31 may be adjusted according to the machining errors and surface roughness of the hinge shaft 3 to correct the perpendicularity of the hinge shaft 3, thereby avoiding poor alignment of the door.

The plastic encapsulating case 31 is provided with a protrusion 311 protruding horizontally outwards along the extension direction of the supporting plate 2, and the protrusion 311 is integrally formed with the plastic encapsulating case 31. The protrusion 311 can reduce the contact area between the hinge shaft 3 and the shaft sleeve to reduce the frictional force therebetween, reduce the fitting clearance between the hinge shaft 3 and the shaft sleeve, and avoid radial shaking of the door.

Two protrusions 311 are arranged on the plastic encapsulating case 31, and are respectively arranged on the two sides of the supporting plate 2 in the height direction of the hinge shaft 3. Of course, the protrusions 311 may be arranged only on one side of the supporting plate 2, or two protrusions 311 may be arranged on each side of the supporting plate 2 according to the needs to further reduce radial shaking of the door.

The protrusion 311 protrudes outwards in a ring shape and comprises an abutting portion 3111 to cooperate with the shaft sleeve in an abutting manner and a transition zone 3112 connecting the abutting portion 3111 and the plastic encapsulating case 31 in an arc shape to reduce the cooperation difficulty between the shaft sleeve and the hinge shaft 3. The maximum outer diameter of the abutting portion 3111 is equal to the inner diameter of the shaft sleeve.

According to the hinge 100 of the refrigerator of the present invention, on one hand, the plastic encapsulating case 31 is plastic-encapsulated outside the hinge shaft 3, so that the hinge shaft 3 is isolated from air and corrosion of the hinge shaft 3 can be prevented. On the other hand, the thickness at respective parts of the plastic encapsulating case 31 may be adjusted according to the machining errors and surface roughness of the hinge shaft 3 to correct the perpendicularity of the hinge shaft 3, thereby avoiding poor alignment or flash clearance of the door. Further, as the ring-shaped protrusion 311 is arranged on the plastic encapsulating case 31, the contact area between the hinge shaft 3 and the shaft sleeve is reduced to reduce the frictional force and the fitting clearance therebetween and avoid shaking of the door. Therefore, according to the hinge 100 of the present invention, the above effects can be realized only by plastic-encapsulating the plastic encapsulating case 31 outside the hinge shaft 3. The hinge is simple in structure and economical in cost, and is therefore worthy of being promoted.

The above embodiments are intended to illustrate rather than limit the technical solutions of the present invention. Although the preferable embodiments describe the present invention in detail, those skilled in the art shall understand that modifications or equivalent substitutions may be made to the technical solutions of the present invention without departing from the spirit and scope thereof.

The invention claimed is:

1. A hinge comprising: a fixing plate, a supporting plate perpendicularly connected with the fixing plate, and a hinge shaft perpendicularly mounted on the supporting plate to cooperate with a shaft sleeve, wherein the outside of the hinge shaft is plastic-encapsulated with a plastic encapsulating case, the plastic encapsulating case is provided with a first protrusion protruding horizontally outwards along an extension direction of the supporting plate, and the first protrusion is integrally formed with the plastic encapsulating case, wherein the plastic encapsulating case is configured as a plastic seal outside of the hinge shaft;

wherein the first protrusion comprises a transition zone, the transition zone connecting an abutting portion and the plastic encapsulating case in an arc shape.

2. The hinge according to claim 1, wherein the plastic encapsulating case is provided with the first protrusion and a second protrusion, and the first protrusion and the second protrusion are respectively arranged on two sides of the supporting plate in the height direction of the hinge shaft.

3. The hinge according to claim 1, wherein the supporting plate is provided with a mounting hole for mounting the hinge shaft which is to be inserted into and fixed in the mounting hole.

4. The hinge according to claim 3, wherein the hinge shaft passes through the mounting hole and is fixed on the supporting plate by a rivet.

5. The hinge according to claim 1, wherein the fixing plate is provided with three screw holes.

6. The hinge according to claim 1, wherein the first protrusion comprises a circular surface, an abutting portion of the circular surface to cooperate with the shaft sleeve in line contact.

7. The hinge according to claim 1, wherein the plastic encapsulating case is provided with four protrusions including the first protrusion, and every two protrusions of the four protrusions are respectively arranged on two sides of the supporting plate in the height direction of the hinge shaft.

8. A refrigerator comprising a cabinet, a door and a hinge for connecting the cabinet and the door, the hinge comprises: a fixing plate, a supporting plate perpendicularly connected with the fixing plate, and a hinge shaft perpendicularly mounted on the supporting plate to cooperate with a shaft sleeve, wherein the outside of the hinge shaft is plastic-encapsulated with a plastic encapsulating case, the plastic encapsulating case is provided with a first protrusion protruding horizontally outwards along an extension direction of the supporting plate, and the first protrusion is integrally formed with the plastic encapsulating case, wherein the plastic encapsulating case is configured as a plastic seal outside of the hinge shaft;

wherein the supporting plate is provided with a mounting hole for mounting the hinge shaft which is to be inserted into and fixed in the mounting hole;

wherein the hinge shaft passes through the mounting hole and is fixed on the supporting plate by a rivet.

9. The refrigerator according to claim 8, wherein the plastic encapsulating case is provided with the first protrusion and a second protrusion, and the first protrusion and the second protrusion are respectively arranged on two sides of the supporting plate in the height direction of the hinge shaft.

10. The refrigerator according to claim 8, wherein the first protrusion comprises a circular surface, an abutting portion of the circular surface to cooperate with the shaft sleeve in line contact.

11. The refrigerator according to claim 8, wherein the plastic encapsulating case is provided with four protrusions including the first protrusion, and every two protrusions of the four protrusions are respectively arranged on two sides of the supporting plate in the height direction of the hinge shaft.

12. A hinge comprising: a fixing plate, a supporting plate perpendicularly connected with the fixing plate, and a hinge shaft perpendicularly mounted on the supporting plate to cooperate with a shaft sleeve, wherein the outside of the hinge shaft is plastic-encapsulated with a plastic encapsulating case, the plastic encapsulating case is provided with a first protrusion protruding horizontally outwards along an extension direction of the supporting plate, and the first protrusion is integrally formed with the plastic encapsulating case, wherein the plastic encapsulating case is configured as a plastic seal outside of the hinge shaft;

wherein the supporting plate is provided with a mounting hole for mounting the hinge shaft which is to be inserted into and fixed in the mounting hole;

wherein the hinge shaft passes through the mounting hole and is fixed on the supporting plate by a rivet.

* * * * *